US006419510B2

(12) United States Patent
Shiraki et al.

(10) Patent No.: US 6,419,510 B2
(45) Date of Patent: Jul. 16, 2002

(54) ELECTRICAL CONNECTOR WITH LATCH ELEMENT RELEASING SHORTING ELEMENT

(75) Inventors: Kazuyuki Shiraki, Toyota; Akira Nagamine, Kariya; Tsuyoshi Osada, Anjo, all of (JP)

(73) Assignees: J.S.T. Mfg. Co., Ltd., Osaka; Toyota Jidosha Kabushiki Kaisha, Toyota, both of (JP)

( * ) Notice: Subject to any disclaimer, the term of this patent is extended or adjusted under 35 U.S.C. 154(b) by 0 days.

(21) Appl. No.: 09/797,259

(22) Filed: Mar. 1, 2001

(30) Foreign Application Priority Data

Mar. 1, 2000 (JP) ..... 2000-060429

(51) Int. Cl.[7] ..... H01R 29/00; H01R 31/08
(52) U.S. Cl. ..... 439/188; 439/507
(58) Field of Search ..... 439/188, 372, 439/332, 675, 944, 352, 507; 200/51.09, 51.1

(56) References Cited

U.S. PATENT DOCUMENTS 5,275,575 A 1/1994 Cahaly et al.
5,314,345 A 5/1994 Cahaly et al.
5,816,840 A 10/1998 Dullin
5,827,083 A 10/1998 Dullin
6,203,342 B1 * 3/2001 Gauker et al. ..... 439/188

FOREIGN PATENT DOCUMENTS

| | | |
|---|---|---|
| DE | 29521491 | 9/1997 |
| JP | 4-33666 | 8/1992 |
| JP | 06-208865 | 7/1994 |
| JP | 06-208867 | 7/1994 |
| JP | 08-264229 | 10/1996 |

* cited by examiner

*Primary Examiner*—Brian Sircus
*Assistant Examiner*—Chandrika Prasad
(74) *Attorney, Agent, or Firm*—Jordan and Hamburg LLP

(57) ABSTRACT

An electrical connection system includes a first component for supporting a first electrical connector element and a second component engaged with the first component and supporting a second female electrical connector element engageable with the first male connector element. A shorting element is mounted in advance on the first component for electrically shorting the first male electrical connector element. A latch element is latched in advance in a first position with respect to the second component. By pressing the latch element, the second component is engaged with the first component and simultaneously the latch element latched in the first latching position is released and pressed further to a second latching position in which the shorting element is released by the latch element.

14 Claims, 15 Drawing Sheets

ELECTRICAL CONNECTOR WITH LATCH ELEMENT RELEASING SHORTING ELEMENT

The present invention relates to a technical field of an electrical connection system. More particularly, the present invention relates to an electrical connection system comprising a first component and a second component with a latch element which allows electric contacts of the first component to be shorted together when the first component and the second component are not in proper electrical connection and allows the electric contacts to be released from the short-circuit when the proper electrical connection of the both components is made.

The present invention is particularly suitable for use in an airbag system for restraining passengers in a vehicle and will be described with reference thereto; however, the invention is capable of broader application and could be used in many different environments and for a variety of purposes.

The airbag system includes an airbag assembly mounted in a hidden compartment within a cab of the vehicle and an electrical or electronic control system. The control system is connected to the airbag assembly by means of a wiring harness which typically is provided with an electrical plug and jack connector arrangement to permit an easy method of electrically joining the airbag assembly and the control system after they have been installed separately.

The connection system incorporates a so-called shorting clip. Shorting clips are small metal elements arranged to electrically short the leads together within the plug or jack before the plug and jack are engaged. Such shorting clips are included as a safety means, to preclude stray leakage of electrical charges and inadvertent misconnection from accidentally triggering the airbag assembly during the manufacturing process.

When the connection system is connected correctly, the safety means for electrical shorting by means of the shorting clip must be moved to a non-shorting position. The connection system having a latch element to release the safety catch is disclosed in U.S. Pat. No. 5,275,575 and Japanese Patent No. 2,647,336. The connection system has the structure in which the electrical connection system is not put into action until the both components are in their full engaged position and the latch element has been moved to its latching position. The latch element functions to prevent accidental disconnection of the both connection components after they are fully connected.

However, two stage operation, consisting of the first step operation of bringing the both components into engagement and the second step operation of inserting the latch element in the both components up to its latching position, is required for putting the connection system into its full connection state. Also, since the latch element is integrally mounted on one of the both components by means of a flexible arm, the one component is increased in size, resulting in being hard to deal with the connection system.

U.S. Pat. No. 5,314,345 and Japanese Patent No. 2,647,335 disclose the connection system wherein when the both components are connected correctly, the electrical shorting by means of the shorting clip is released, while also, once the latch element is inserted therein, the connection of the both components is prevented from being accidentally disconnected.

However, two stage operation is required for putting the connection system into its fully connected state, as is the case with U.S. Pat. No. 5,275,575. Also, due to the provision of the latch element, one of the components is increased in size, resulting in being hard to deal with the connection system.

Japanese Utility Model Publication No. Hei 4(1992)-33,666 discloses the connection system wherein after the electrical connection has been taken place correctly between the first and second components, the latch element latched in advance in the second component is pressed so that it can be latched at the position where the both components are prevented from being disconnected accidentally. However, it has no shorting element for the first component. In addition, the engaging operation of the both components and the pressing operation of the latch element are taken place in two stages.

SUMMARY OF THE INVENTION

The present invention provides the electrical connection system that can effect the engaging operation of the both components and the pressing operation of the latch element for releasing the shorting of the shorting element in the one component element in one continuous motion and also can be designed to be compact on the whole.

It is a primary object of the present invention to provide the electrical connection system wherein after the latch element latched in a first position with respect to one of two components is pressed in to bring the both components into engagement, it can be pressed continuously to a second position in which the shorting of the shorting element in the other component is released by the latch element, whereby the connection is effected in one operation as a whole.

It is another object of the present invention to provide the electrical connection system wherein the latch element is designed to project out from the one component to only a required minimum extent to press the latch element to the second position when the latch element is in the first position, so as to enable the entire connection system to be made compact in size.

It is still another object of the present invention to provide the electrical connection system wherein the latch element is designed to press in from the first position to the second position, and as such enables the visual check on whether the both components are in the connected state.

It is a further object of the present invention to provide the electrical connection system wherein when the latch element is pressed in from the first position to the second position, it acts to release the shorting of the shorting element and also prevent the both components from being separated from each other, to accomplish the full connection of the both components.

The present invention provides an electrical connection system including a first component for supporting a first male electrical connector element and a second component engaged with the first component and supporting a second female electrical connector element engageable with the first male electrical connector element. A shorting element is mounted in advance on the first component, for electrically shorting the first male electrical connector element. A latch element is latched in advance in a first latching position with respect to the second component. By pressing the latch element, the second component is engaged with the first component and simultaneously the latch element latched in the first latching position is released and is pressed further to the second latching position in which the shorting of the shorting element is released by the latch element.

Preferably, when the latch element is in the latched state in the first position, a part of the same projects out from the second component, while on the other hand, when the second component is in engagement with the first component and the latch element is in the latched state in the second position, the part of the same is accommodated in a recess in the second component.

As apparent from the description above, the latch element is pressed to move from the first latching position to the second latching position and, thereby, both the engagement of the first and second components and the release of the shorting by the shorting element are effected in one continuous pressing operation. In addition, the proper electrical connection between the first and second components can be confirmed by simply checking that the latch element is in the second position.

According to a further limitative feature of the present invention, the latch element is provided with a restricting portion for restricting an action of the second component to disengage from the first component, in order to prevent the disconnection, when the first and second components are in engagement with each other and the latch element is in the second latching position

PREFERRED EMBODIMENTS OF THE INVENTION

The preferred embodiments of the invention will be described below. These and other objects and advantages of the invention will become apparent upon reading the following description with reference to the accompanying drawings. It is to be noted, however, that the showings are for the purpose of illustrating a preferred embodiment of the invention only and not for the purpose of limiting the invention.

Figure 1:
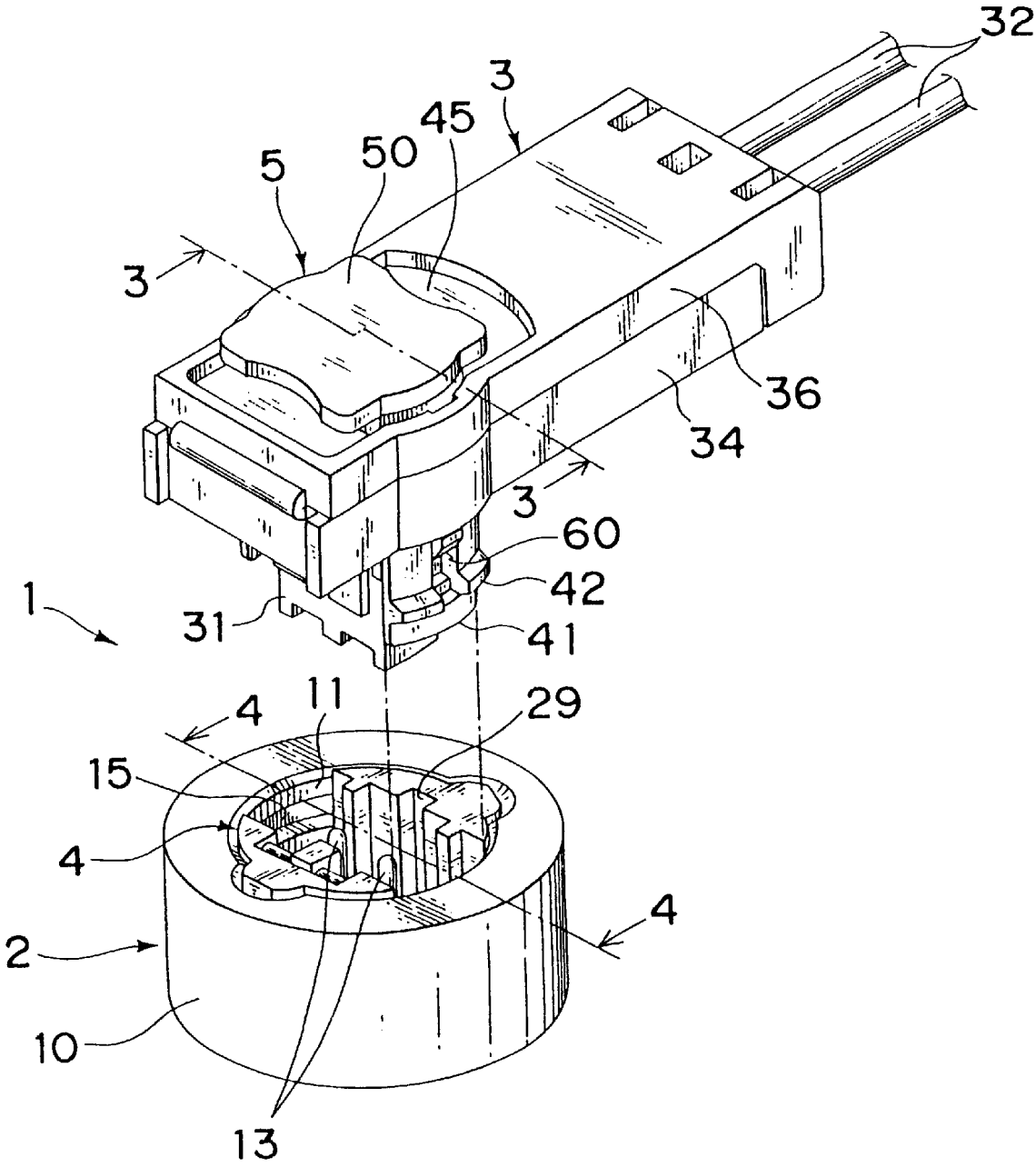
FIG. 1 is a perspective view showing the overall arrangement of a connector system or an electrical connection system 1 for use in an airbag system.

Referring particularly to the accompanying drawings, the details of the overall arrangement of a connector system or an electrical connection system 1 for use in an airbag system are shown in FIG. 1. Shown is the connector system in a before-engagement condition, which comprises a first component 2 in the form of a jack and a second component 3 in the form of a plug engageable with the first component 2.

The first component 2 is provided as a part of an airbag igniter (sometimes referred to as a squib) that must be electrically coupled to a control system of an airbag system. The igniter is a pyrotechnic device which will combust when sufficient electrical energy is applied to it via its two electrical leads 32. Combustion of the igniter causes ignition of gas generating material and consequent inflation of the airbag.

A shorting insert 4 is attached to the first component 2 in a fitted condition. The shorting insert 4 shorts out contacts of the first component 2 until the components 2, 3 are mechanically and electrically engaged with each other.

The second component 3 is electrically coupled with the control system and is engaged with the first component 2. A latch element 5 is held in the second component 3 in a latched state in a first latch position as shown.

The functioning and interrelation of these various components will subsequently become apparent from the following description. As apparent from the following description, the second component 3, the shorting insert 4 and the latch element 5 are preferably molded of suitable electrically non-conductive plastic material except for the various wires and contacts.

Figure 4:
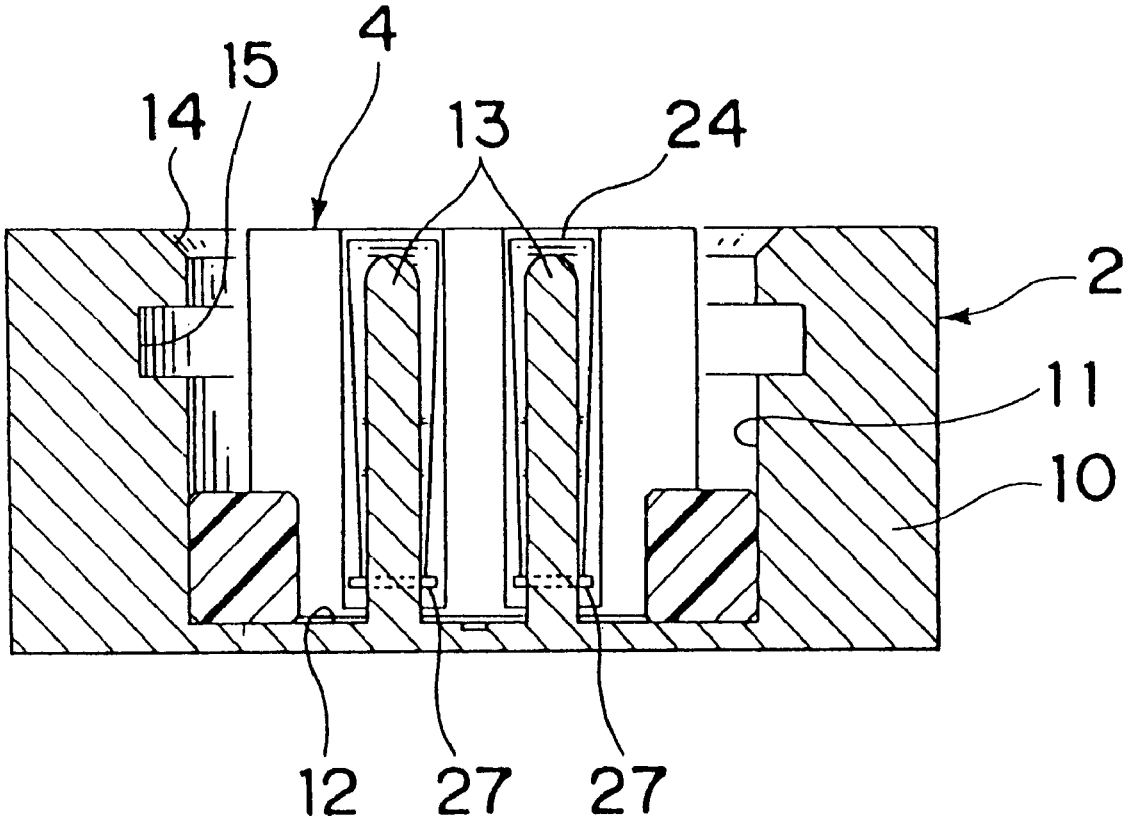
FIG. 4 is a sectional view taken along line 4—4 of FIG. 1.
Figure 5:
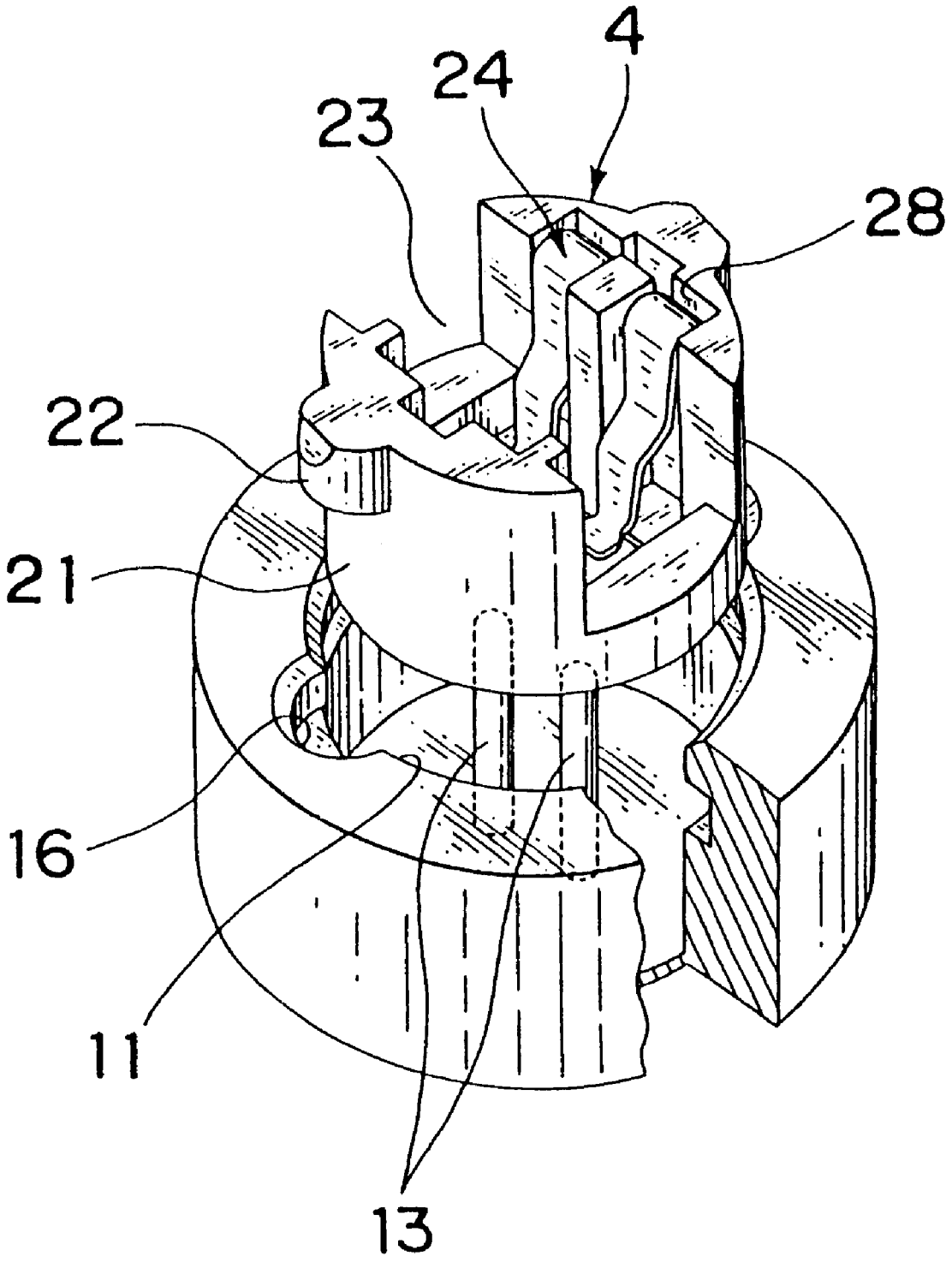
FIG. 5 is a perspective view of a shorting insert in the first component.

Referring particularly to the first component 2, the component 2 is shown in FIGS. 1, 4 and 5 as comprising a cylindrical body 10 defining an opening or a socket 11. The body 10 that defines the socket 11 can be directly incorporated into an associated structure, such as a housing of the igniter or the like. Further, it should be noted that the socket 11 can be formed as a separate, distinct element and added to the associated structure. In any event, the body 10 that defines the socket 11 terminates a bottom wall 12 from which a pair of first, metallic, electrically conductive, male connector elements or pins 13 extend, as best shown in FIG. 4. The two pins 13 are coupled in any conventional fashion to respective leads of an airbag igniter (not shown) such that the coupling of electrical energy to the igniter through the pins 13 will cause the igniter to fire.

Figure 10:
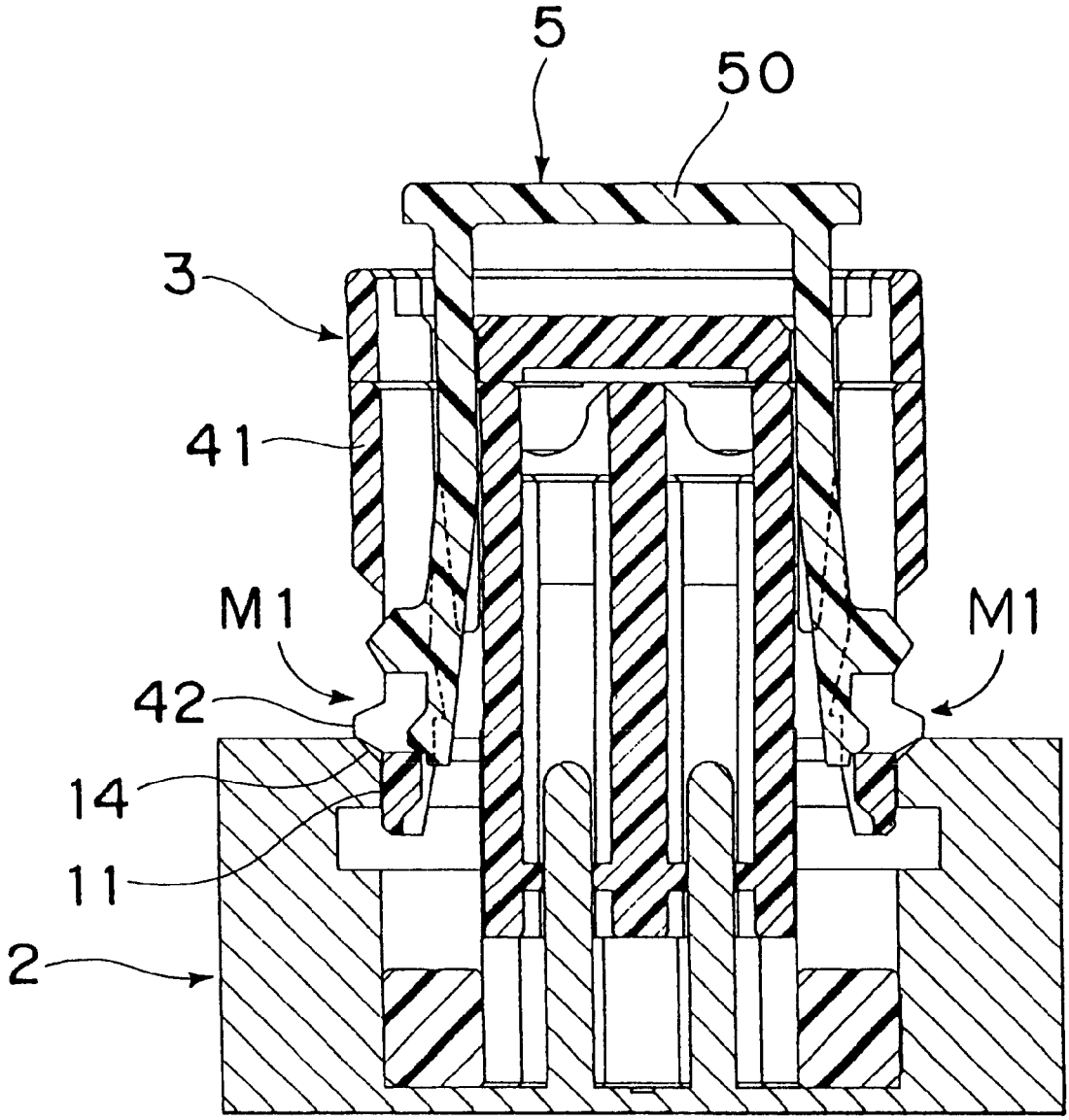
FIG. 10 is a widthwise sectional view showing the initial condition of the engagement of the second component to the first component.
Figure 12:
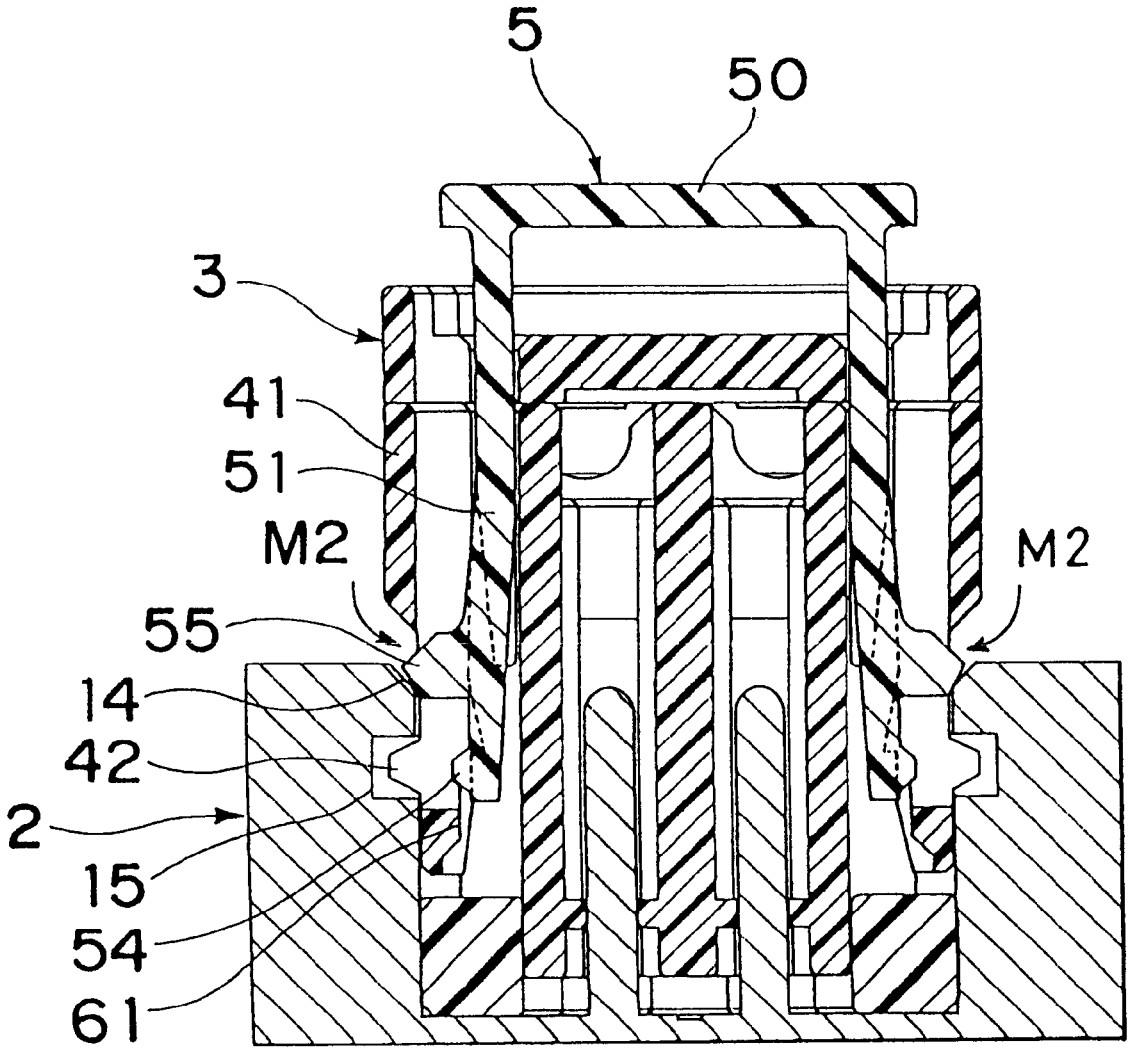
FIG. 12 is a widthwise sectional view showing the second element which is in the process of engaging to the first component.
Figure 13:
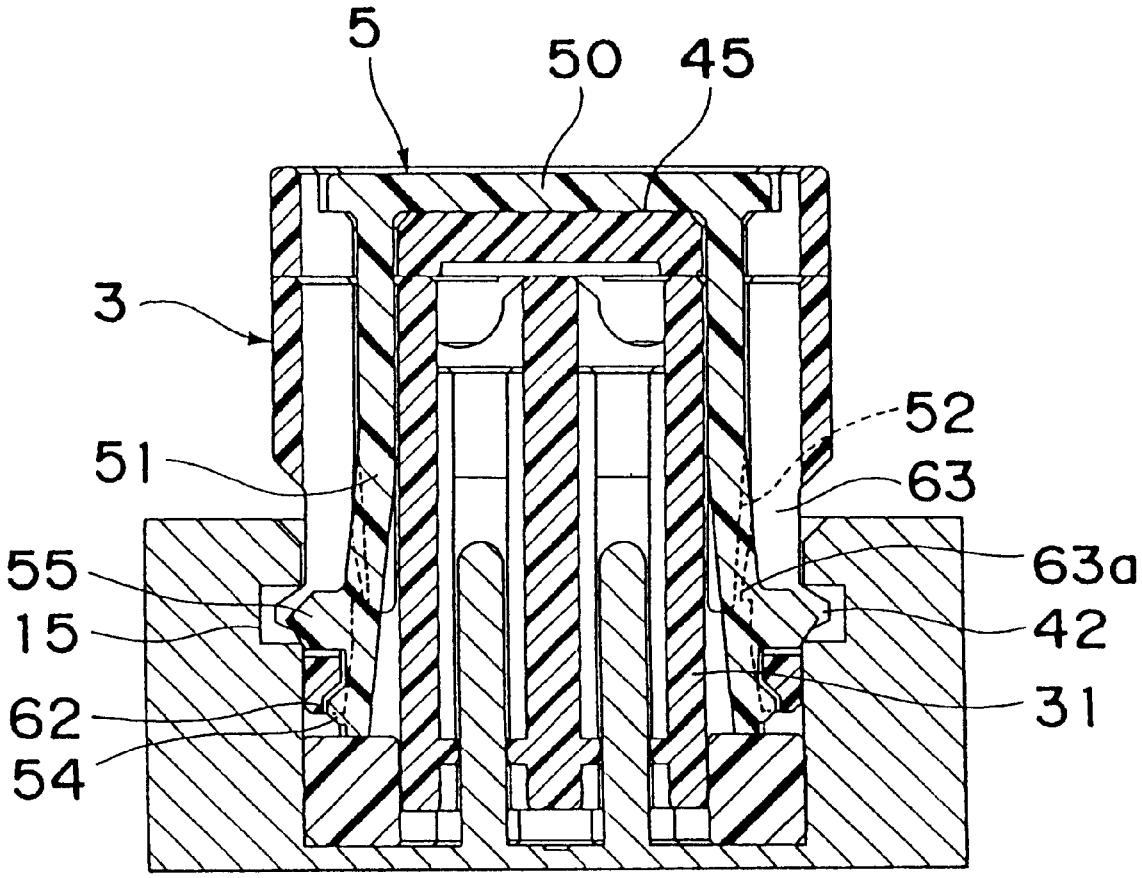
FIG. 13 is a widthwise sectional view showing the state in which the engagement of the second component to the first component is completed.

A slant surface 14 is formed at an inlet of the socket 11, and a circumferentially continuous latch groove 15 is formed in the inside of the socket 11. The slant surface 14 acts to receive latch portions 42 of resilient legs 41 of the second component 3 and produce a centrally-oriented deformation moment, as best shown in FIG. 10. It also acts to receive latch portions 55 of the latch element 5 and produce a centrally-oriented deformation moment, as best shown in FIG. 12. The latch groove 15 acts to receive the latch portions 42 of the second component 3 and keep them in the engaged state, as best shown in FIG. 12. It also acts to receive the second latch portions 55 of the latch element 5 and switch it to the second latch position, as best shown in FIG. 13.

As shown in FIG. 5, the socket 11 is provided, at one location of its inlet, with a semicircular recess 16. The recess 16 acts to orient the shorting insert 4 when it is placed into the socket 11.

The shorting insert 4 is received in the socket 11 and acts to short out the male connector elements 13 by providing electrical connection while the second component 3 is not engaged with the first component 2 so that the latch element 5 of the second component 3 is not in the second latch position.

As best shown in FIG. 5, the shorting insert 4 comprises a columnar molded plastic body 21 that is sized to be closely received in the socket 11. The upper surface of the body 21 is provided, at a side thereof, with a short, downwardly extending semi-cylindrical projection 22 that is positioned and is sized to be received within the recess 16. The projection 22 acts to assure proper orientation of the shorting insert 4 relative to the socket 11. Further, the body 21 includes openings 23 which are centrally located and open to an upper surface and both side surfaces and through which the male connector elements or the pins 13 extend.

A shorting clip 24 is retained in the body 21 of the shorting insert 4. The shorting clip 24 is formed of resilient, electrically conductive material such as spring metal. A part of the shorting clip 24 is deflected to the direction for it to abut with the both pins 13, to form an electrical short circuit between the shorting clip 24 and the pins 13.

Figure 6:
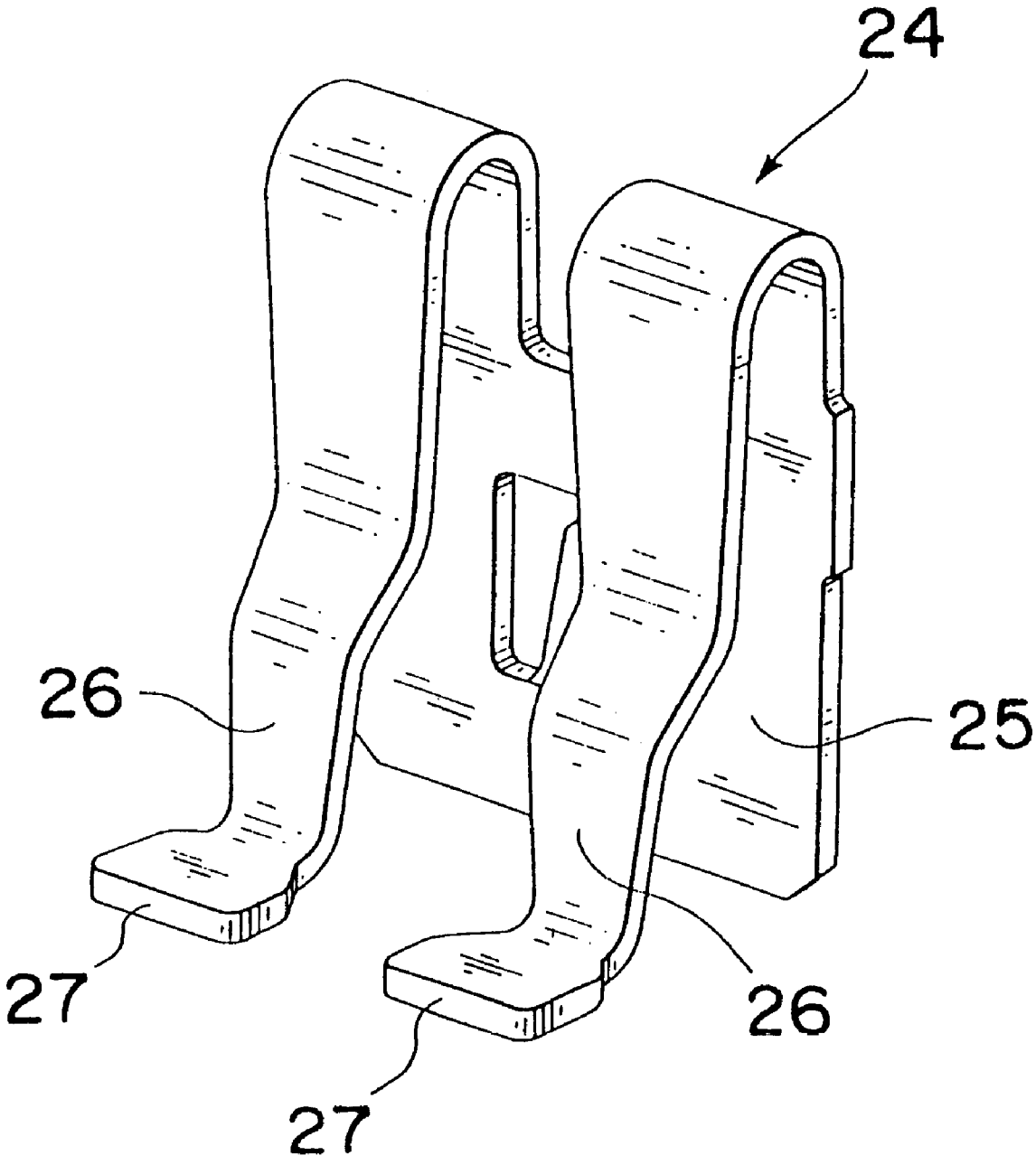
FIG. 6 is a perspective view of a shorting clip contained in the shorting insert.

As best shown in FIG. 6, the shorting clip 24 comprises a plate-like base 25, a pair of legs 26 folded at the top of the base 25 and extending downwardly therefrom and a pair of abutting portions 27 folded at angle of 90° at bottom portions of the pair of legs 26. The legs 26 are each folded stepwise in the direction of being away from the base 25 and deflected so that the abutting portions 27 can abut with the lateral sides of the both pins 13 to provide electrical connection between the abutting portions 27 and the pins 13. As shown in FIG. 5, the shorting clip 24 is retained in the body 21 of the shorting insert 4 by inserting the base 25 into a slit-like recess 28 of the shorting insert 4 in such a manner as not to be pulled out.

FIG. 4 shows the shorting insert 4 which is in the shorting position. The shorting insert 4 is in place in the socket 11, and the two pins 13 abut with the abutting portions 27 of the short clip 24 at the lower side surfaces thereof, to be electrically engaged therewith and extend upwards through the opening 23.

The second component 3 of the connector system or the electrical connection system 1 can be best understood with reference to FIGS. 1, 3 and 7 through 9. As shown therein, the second component 3 includes a main body portion or a central plug portion 31 that extends downwardly and carries a pair of electrically conductive contacts 30 in the form of second female connector elements (See FIGS. 3 and 9). The electrical contacts 30 are electrically connected with a conductor 32. The electrical contacts 30 are arranged and sized to receive the pins 13 of the first component 2.

Figure 3:
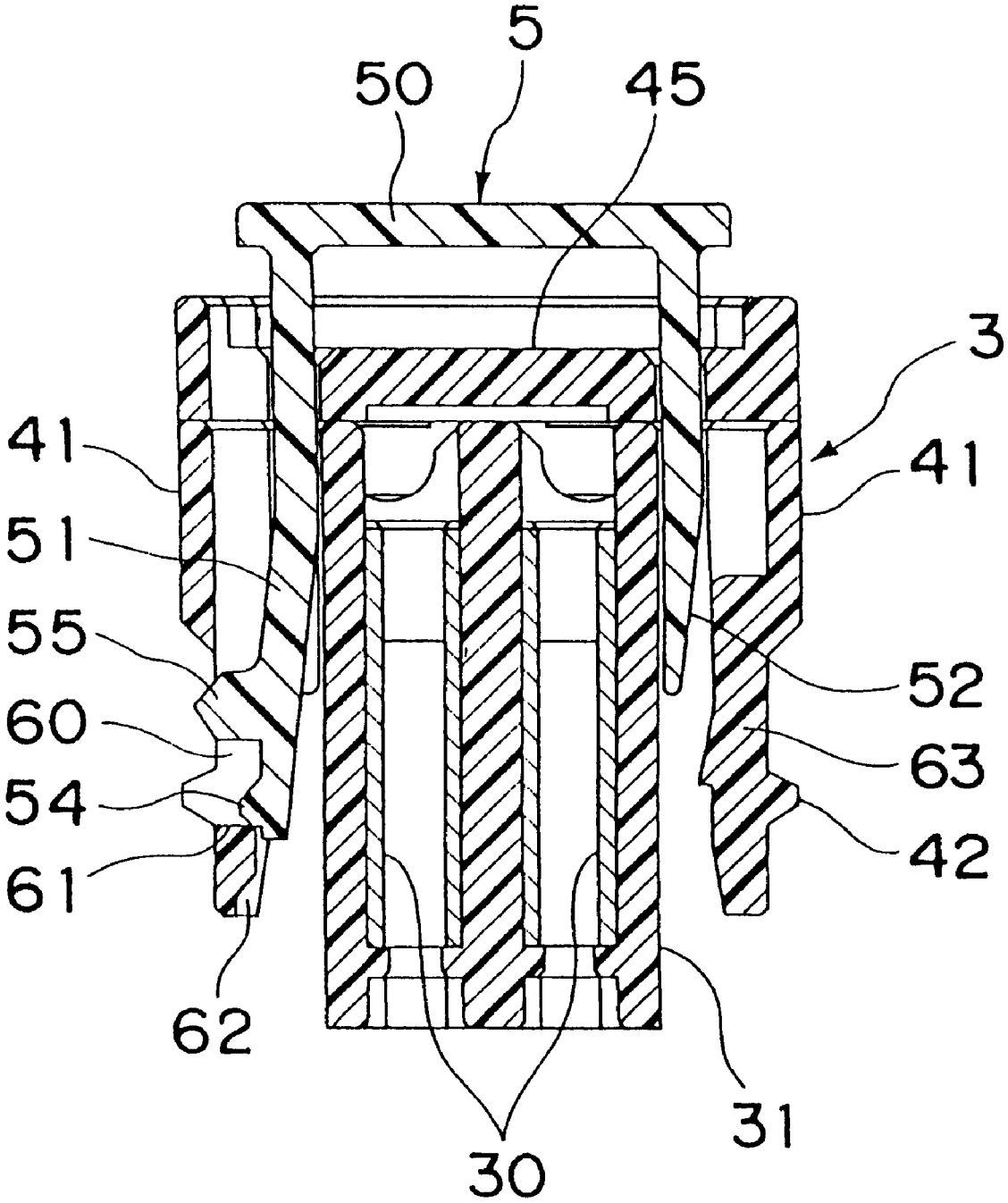
FIG. 3 is a sectional view taken along line 3—3 of FIG. 1.
Figure 7:
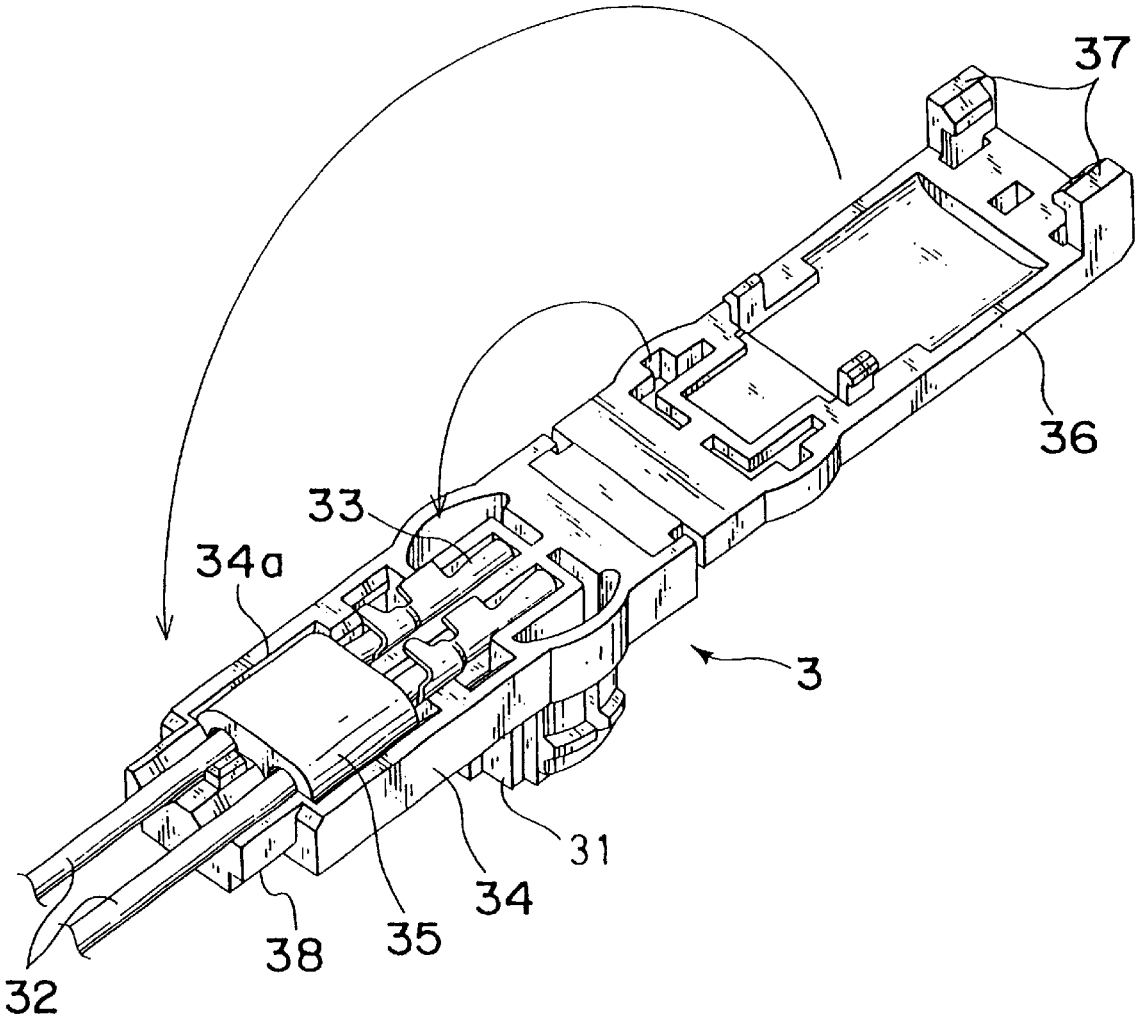
FIG. 7 is a perspective view showing an interior of the second component.

As best shown in FIGS. 3 and 7, each electrical contact 30 incorporated in the central plug portion 31 has a conductor connecting portion 33 that extends from the cylindrical terminal forming the second female connector element and turns into a generally L-shape, for connection to a corresponding one of two conductors 32. These conductors 32 are insulation-sheathed wires whose ends are stripped for electrical and mechanical joining to the corresponding conductor connecting portion 33. The wires are attached thereto in any conventional manner, usually by crimping a part of the conductor connecting portion 33 around the bare end of the wires. The conductors 32 pass through a ferrite bead 35 disposed within a cavity 34*a* in a box-shaped lower portion 34 of the second component 3. The bead 35 is a generally box-shaped homogeneous substance and is pierced by two parallel, cylindrical through-holes through which the conductors 32 pass. The conductors 32 emerge from a lower end of the main body, passing through openings in the rear wall of the cavity 34*a*.

Figure 9:
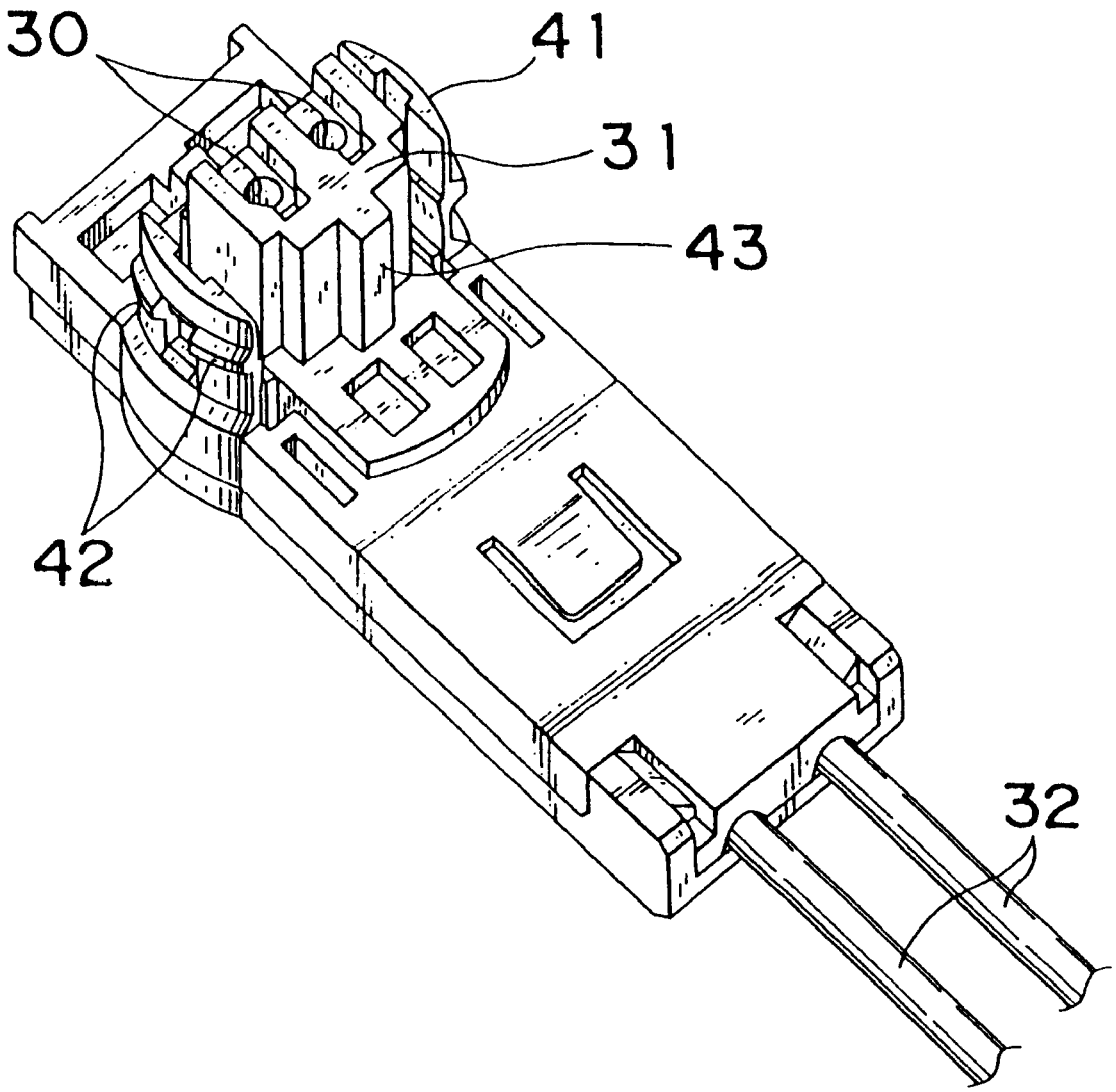
FIG. 9 is a perspective view of the second component after insertion of the latch element, as viewed from the bottom.

The central plug portion 31 has a generally quadratic cylinder shape, as best shown in FIG. 9. The pair of arcuate resilient legs 41 are positioned laterally outward to be opposed to side surfaces of the central plug portion 31. The resilient legs 41 extend downwardly and carry the radially outwardly extending latch portions 42. As best shown in FIG. 13, the latches portions 42 are sized and located to enter into the latch groove 15 when the second component 3 is properly engaged therein.

These resilient legs 41 are located and sized to be closely engaged in the interior of the socket 11 and provide a rigid frame for locating the second component 3 within the socket 11 defined by the first component 2. Further, the central plug portion 31 has a convex 43, shown in FIG. 9. The convex 43 is sized and located so as to engage with a concavity 29 opening upwardly of the shorting insert 4 shown in FIG. 1. The engagement between the convex 43 and the concavity 29 assures the proper connection between the two electrical contacts 30 of the second component 3 and the two pins 13 of the first component 2.

As best shown in FIG. 7, the second component 3 further includes an upper part 36 which encloses a lower part 34 and provides enclosure for the leads 32 and engages them in such a manner as to provide strain relief. The upper part or the cover 36 is integral with the lower part 34 so that the lower part 34 can be folded back in the direction of an arrow. These two parts 34, 36 are integrated into a generally rectangular solid by engagement between a pair of spaced apart, elastic, tab extensions 37 extending downwardly from an end of the upper part 36 and the pair of latches formed at the end of the lower part. This locks the two parts 34, 36 of the second component 3 in proper related engagement as shown in FIGS. 8 and 9.

Figure 8:
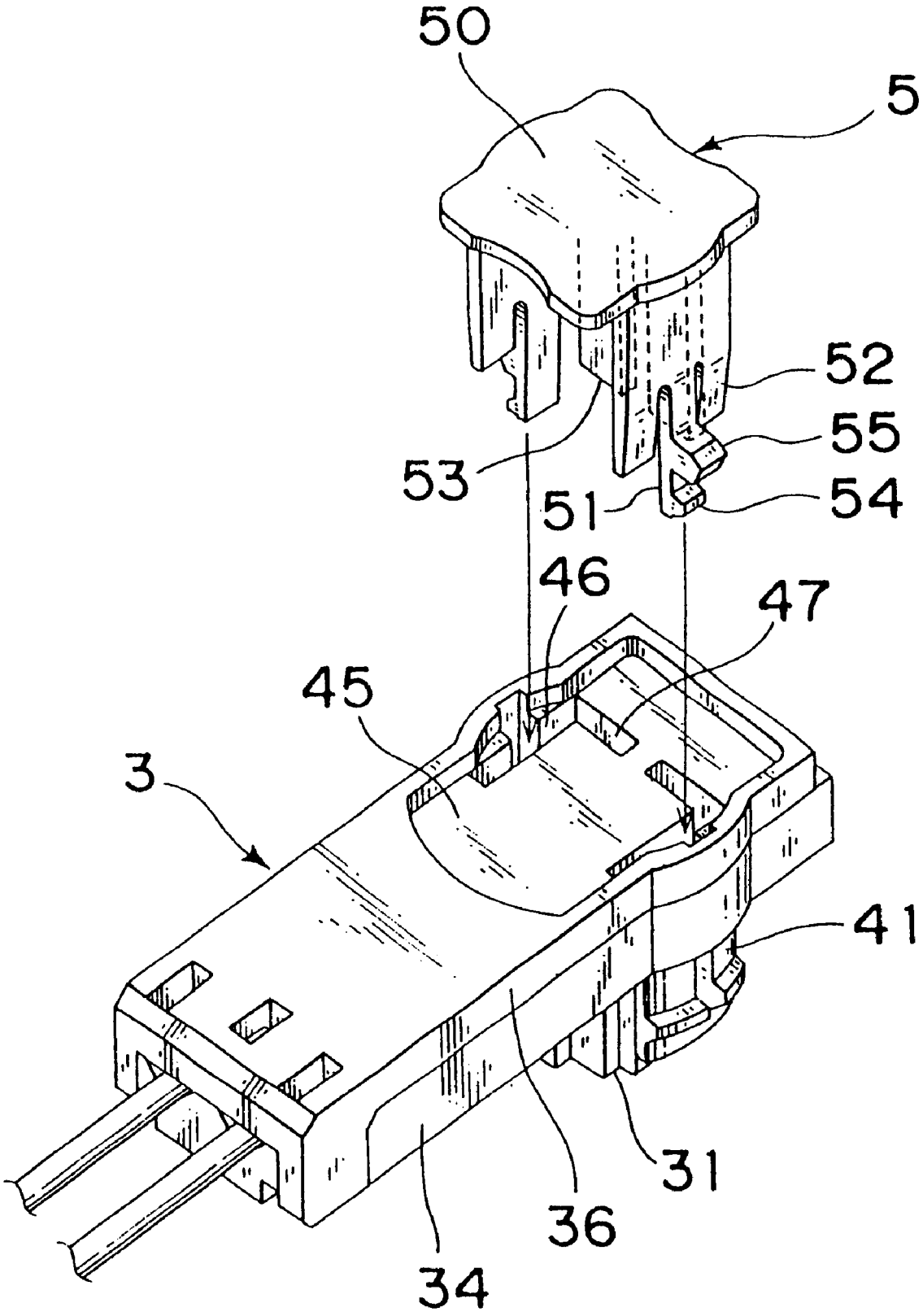
FIG. 8 is a perspective view of the second component before insertion of the latch element, as viewed from the top.

As best shown in FIG. 8, the upper part 36 of the second component 3 has a shallow and wide recess 45 in its upper surface at the corresponding position over the central plug portion 31. A pair of first, spaced apart, through openings 46 are formed so as to confront each other across a space between the central plug portion 31 and the resilient legs 41 from both widthwise sides of the recess 45. A pair of second through openings 47 are formed so as to be placed in line from lengthwise ends of the recess 45 toward the lateral sides of the central plug portion 31. In FIG. 8, the first through openings 46 and the second through openings 47 are continuous to form generally L-shaped through openings. By virtue of this configuration of the generally L-shaped through openings, sufficient strength can be maintained for the electrical connection system without reducing the mechanical strength of the upper portion 36 of the second component 3. When inserted in these through openings 46, 47, the latch element 5 works in association with the central plug portion 31 to latch the latch element 5 in the first latch position.

The latch element 5 includes a head portion or a pressing portion 50, a pair of first legs 51 extending downwardly from both widthwise sides of the pressing portion 50, restricting portions 52 positioned at both sides of the first legs 51 and a pair of second legs 53 extending downwardly in a line from a lengthwise end of the pressing portion 50. The first legs 51 and the second legs 52 are arranged in a generally L-shaped, and the second legs 52 are so arranged as to confront each other across the slits 58. These are arranged and sized to be inserted into the generally L-shaped through openings formed in the upper part 36 of the second component 3. This locks those parts in proper related engagement as shown in FIG. 8. The first legs 51 include the first latch portions 54 and the second latch portions 55 in the positional order from below. The first latch portion 54 is shaped to project slightly outwardly and the second latch portion 55 is shaped to project largely outwardly.

Figure 2:
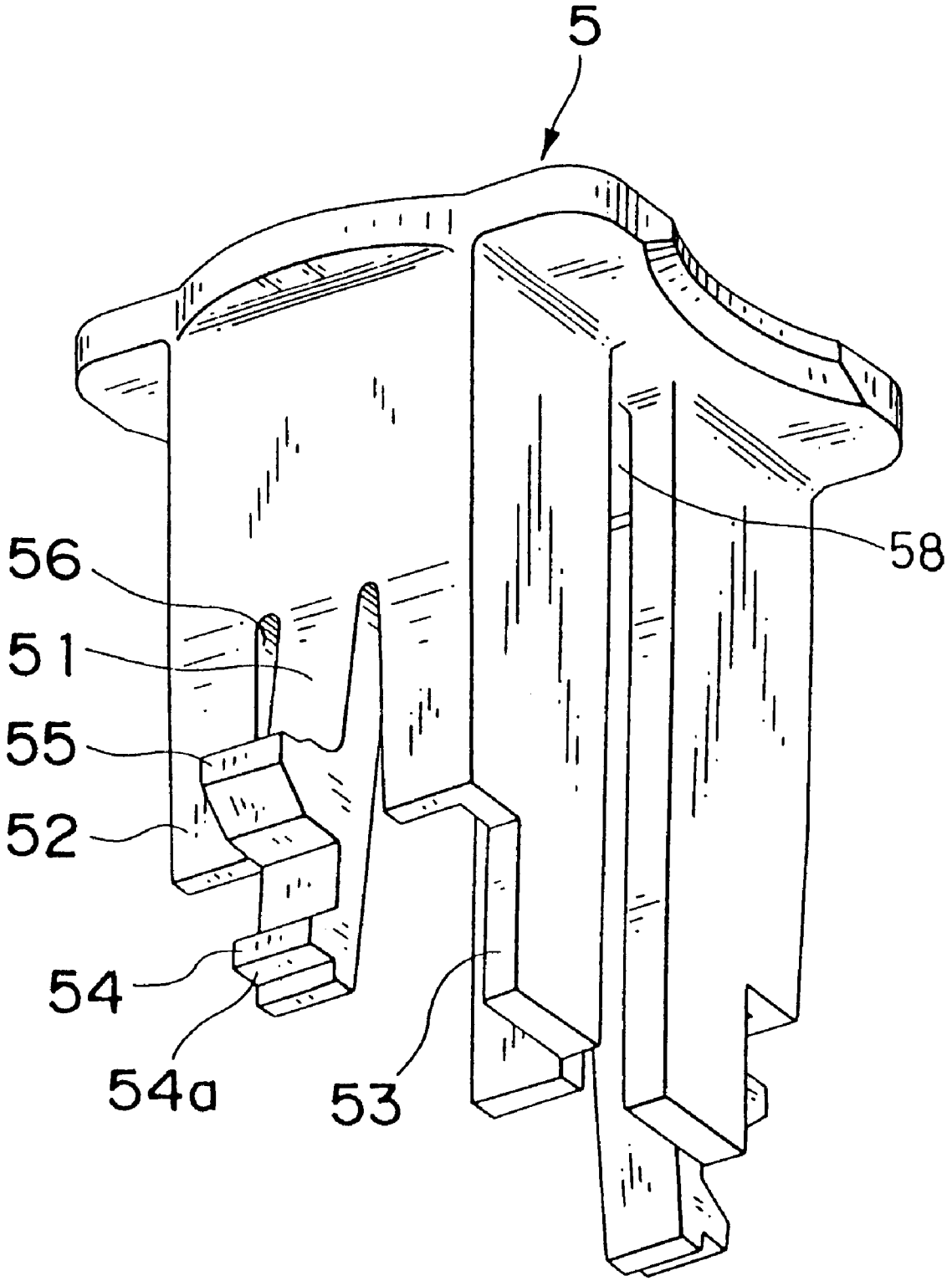
FIG. 2 is a perspective view of the latch element.

The latch element 5 is best shown in FIG. 2. The first latch portion or the small projecting portion 54 of the first leg 51 has a stepped portion 54*a* at the tip end. As best shown in the left side of FIG. 3 which is a sectional view taken along line 3—3 of FIG. 1, a stepped portion 61 is formed at a lower end of an opening 60 in the resilient legs 41 of the second component 3. In the state in which the latch element 5 is inserted in the second component 3, the stepped portion 54*a* of the first leg 51 is in abutment with the stepped portion 61 of the resilient leg 41 and thus in the latched state at the first latch position. In that time, the second latch portion or the largely projecting portion 55 of the latch element 5 projects outwardly from the opening 60, so that it is put in the operable state. A radially inwardly hollowed out, latch groove 62 is formed in the interior of the resilient leg 41 at the lower end thereof The outward projecting portion of the first latch portion 54 of the latch element 5 as shifted from the first latch position is latched in the latch groove 62, so that the latch element 5 is placed in the second latch position. The latching magnitude in the second latch position is set to the extent to which the latch element 5 can be returned to the first latch position by pulling it up from the second component 3.

As best shown in FIG. 2, the restricting portions 52 at the both sides of the first leg 51 are arranged through slits 56 which are configured not to hinder the elastic deformation of the first leg 51 and are formed to reduce in thickness towards the bottom ends. As best shown in the right side of FIG. 3 which is a sectional view taken along line 3—3 of FIG. 1, the restricting portion 52 is positioned between an inside wall-thickness portion 63 of the resilient leg 41 of the second component 3 and an outside portion of the central plug portion 31. In the state in which the latch element 5 is in the first latch position as shown or the head portion 50 is away from the second component 3, inward deformation of the latch portions 42 of the resilient legs 41 is not restricted by the restricting portions 52. As best shown by a dotted line in FIG. 13, when the latch element 5 is shifted to the second latch position where the head portion 50 is accommodated in the recess 45, the restricting portions 52 are lowered to the position where they confront an inward protruded portions 63*a* of the wall-thickness portions 63. Thus, when the latch portions 42 are tried to disengage from the latch groove 15, the inward protruded portions 63*a* are brought into abutment with the restricting portions 52 to prevent the disengagement of the latch portions 42. In the normal state, however, the restricting portions 52 define a gap between the restricting portions and the central plug portion 31 or the wall-thickness portion 63 of the resilient leg 41. This assures that the first latch element 5 is shifted from the first latch position to the second latch position, for smooth insertion thereof.

Figure 14:
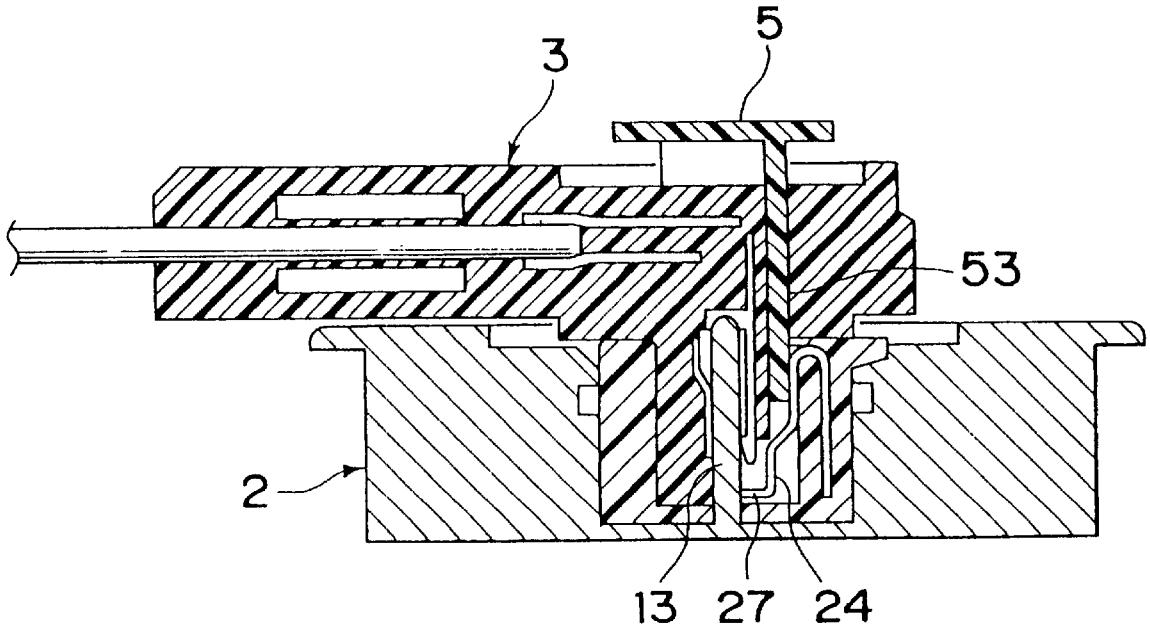
FIG. 14 is a longitudinal sectional view, corresponding to FIG. 12, showing the second component which is in the process of engaging to the first component.
Figure 15:
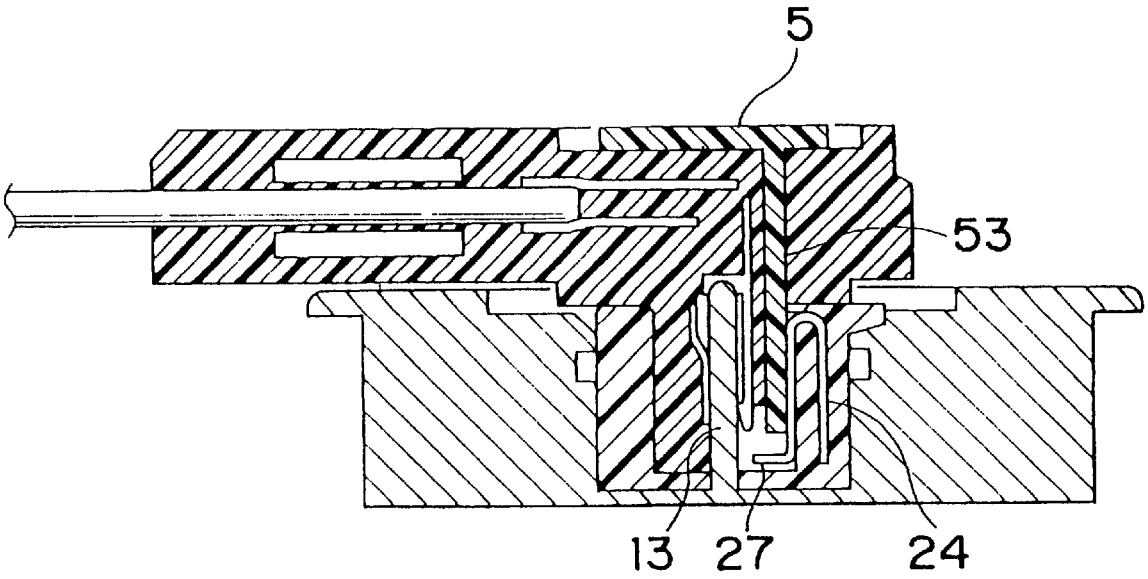
FIG. 15 is a longitudinal sectional view, corresponding to FIG. 13, showing the state in which the engagement of the second component to the first component is completed.

As best shown in FIG. 2, the second legs 53 are formed by the plates confronting each other across the slit 58 and extending to the lowermost ends. The slit 58 extends from the back of the head portion or the pressing portion 50 to the ends of the second legs 53, and the head portion 50 is configured to be surely accommodated in the recess 45. Thus, the provision of the slit 58 enables the through openings formed in the upper part 36 of the second component 3 to be formed in a generally L-shape, and as such can provide sufficient mechanical strength for the electrical connection system. Also, as best shown in FIGS. 14 and 15, when the latch element 5 is plugged from the first latch position to the second latch position, the second legs 53 are advanced to the folded portions of the shorting clip 24 to let the abutting portions 27 move away from the pins 13, so as to release the electrical shorting to the pins 13. The second legs 53 may be so modified that either of them is extended downwardly to reach the folded portions of the shorting clip 24 and also is so formed as to have a particular shape to let the abutting portions 27 move away from the pins 13.

The connecting motion of the above-mentioned connector system or electrical connection system 1 will be described with reference to FIGS. 1 through 3 and 10 through 15. As shown in FIGS. 1 and 4, the shorting insert 4 is pre-fitted in the socket 11 of the first component 2 to achieve the electrical shorting of the pins 13. As shown in FIGS. 1 and 3, the latch element 5 is latched in advance to the second component 3 in the first position or in the state in which the first latch portions 54 are abutted with the stepped portions 61. In the condition in which the second component 3 is separated from the first component 2, as shown in FIG. 1, the latch element 5 is not lowered even when it is pressed against the second component 3. Thus, the head portion 50 of the latch element 5 is kept in the state of being floated from the recess 45 in the second component 3, which can be visually confirmed.

Figure 11:
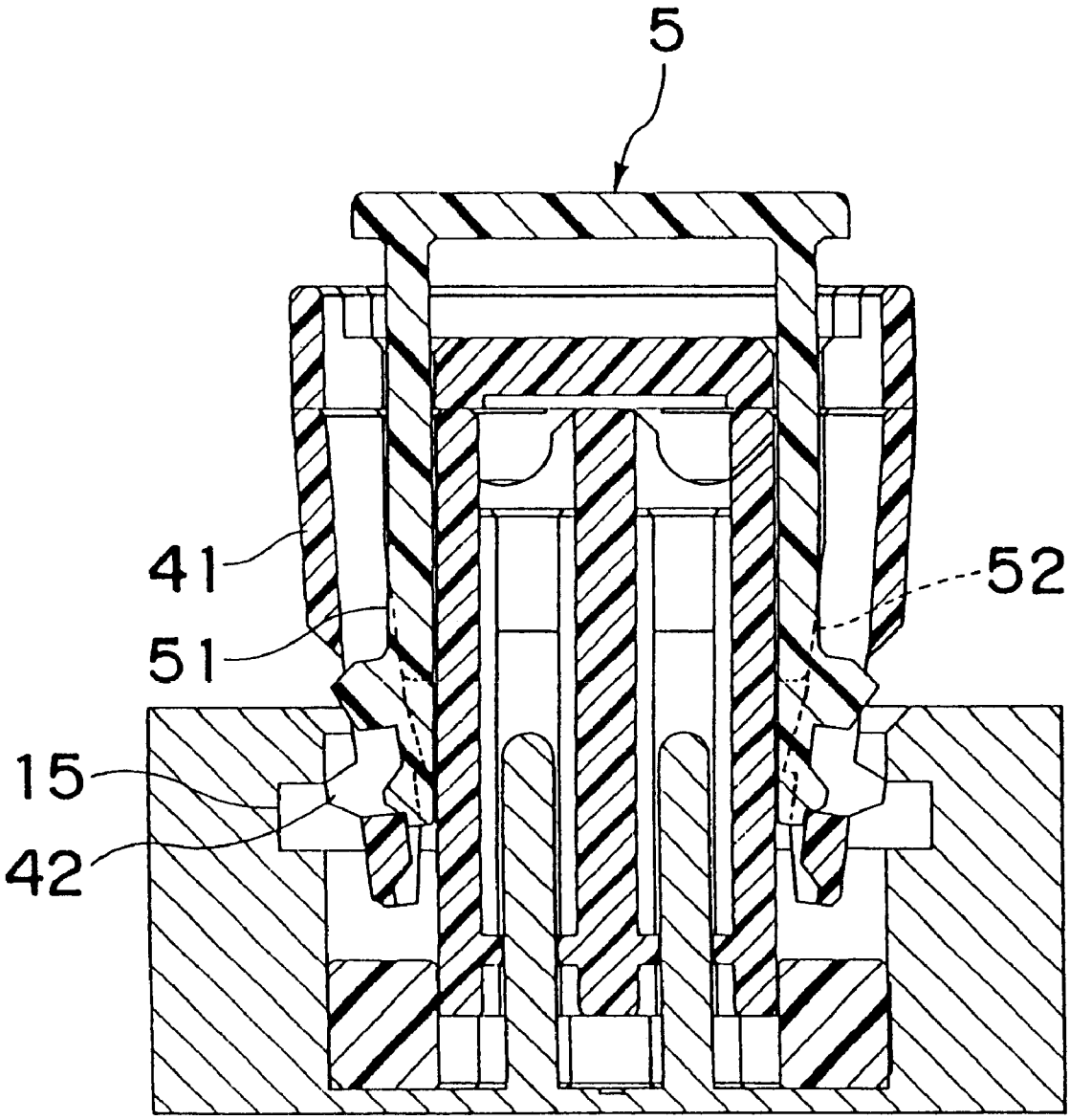
FIG. 11 is a widthwise sectional view showing the second element which is in the process of engaging to the first component.

FIG. 10 clearly shows the state in which the lower end portions of the resilient legs 41 extending in parallel to each other are inserted in the socket 11 of the first component 2 with one's hand grasping the lateral sides of the upper and lower parts 34, 36 of the second component 3. The latch portions 42 of the resilient legs 41 are abutted with the slant surface 14 at the inlet of the socket 11 and are rested thereat. When the head portion 50 of the latch element 5 is pressed with e.g. a thumb in this state, the inward-directed moment M1 is produced in the resilient legs 41. As shown in FIG. 11, the resilient legs 41 and the first legs 51 are bent inwardly, so that the latch portions 42 of the resilient legs 41 are fitted in the latch groove 15. The restricting portions 52 of the latch element 5 are then in their upper position, so that they do not restrict the deformation of the resilient legs 41.

As shown in FIG. 12, when the latch potions 42 of the resilient legs 41 are fitted in the latch groove 15, the second latch portion 55 of the latch element 5 is brought into interference with the slant surface 14 at the inlet of the socket 11. As a result of this, the inward-directed moment M2 is produced in the first legs 51, so that the first latch portions 54 of the first legs 51 are already away from the stepped portions 61 of the resilient legs 41. Thus, the pressing operation of the head portion 50 of the latch element 5 can be continued to lower the latch element 5 further.

As shown in FIG. 13, when the second latch portions 55 of the first legs 51 are fitted in the latch groove 15, the latch element 5 is placed in the second latch position in which the first latch portions 54 of the first legs 51 are latched in the latch groove 62. Also, the restricting portions 52 of the latch element 5 are lowered to the position where they confront the inward protruded portions 63*a* of the wall-thickness portions 63 (near the position where the latch groove 15 and the latch portions 42 are engaged), to restrict the disengagement of the latch portions 42 from the latch groove 15. Thus, the second component 3 is prevented from being disengaged from the first component 2. In the second latch position, the head portion 50 of the latch element 5 is sunk in the recess 45 in the second component 3, so that the completion of the mechanical engagement of the first component 2 and the second component 3 can be confirmed visually.

FIG. 14 is a longitudinal sectional view corresponding to the widthwise sectional view of FIG. 12. As shown therein is the state in which the second component 3 is engaged with the first component 2 and the latch element 5 is going to be pressed further. In this state, the tip ends of the second legs 53 of the latch element 5 do not reach stepped, bent portions of the shorting clip 24 at a midpoint thereof. As a result of this, the abutting portions 27 are abutted with the lateral sides of the pins 13 to keep them in the shorting state. FIG. 15 is a longitudinal sectional view corresponding to the widthwise sectional view of FIG. 13. The tip ends of the second legs 53 of the latch element 5 make the stepped, bent portions of the shorting clip 24 at the midpoint thereof straight. As a result of this, the abutting portions 27 are moved away from the lateral sides of the pins 13 to release the shorting state of the pins 13 and complete the electrical fitting engagement.

Thus, the mechanical engagement between the first component 2 and the second component 3 and the electrical fitting engagement there between can be completed simultaneously in one operation of simply pressing the latch element 5. Once the mechanical engagement between the first component 2 and the second component 3 is completed, the second component 3 cannot be disengaged from the first component 2 unless the latch element 5 is returned to the first latch position from the second latch position.

The present invention has been described with reference to the preferred embodiment. Of course, variations and applications of the invention will become apparent upon reading and understanding the specification, and it will be understood that it is intended to cover in the scope of the invention all such variations and applications and equivalents as fall in the appended claims.

For example, the pair of legs 26, 26 of the shorting clip 24 may be formed in the form of a single sheet of plate. The pair of abutting portions 27 formed by folding the pair of legs 26 at angle of 90° at the tip end portions thereof are not limited to the form as shown in the embodiment but may be so modified that they can have a configuration to bring the legs 26 into direct contact with the pins 13.

Also, the latch element 5 may be so modified in form as to have no slit 58 formed between the second legs 53. Specifically, modification may be made, for example, by forming the second leg 52 in the form of a single sheet of plate between the pair of first legs 51 and disposing the first legs 51 and the second leg 52 in a generally U-like shape. In this modification, the through openings in the upper part 36 of the second component 3 must be modified in form to have a corresponding generally U-like shape. When the through openings in the upper part 36 of the second component 3 are formed in the generally U-like shape, the second component 3 is reduced in mechanical strength, but the reduction of the strength can be complemented by inserting in the second component the latch element 5 formed by the legs 51, 52 formed in the generally U-like shape.

The latch element 5 according to the present invention is applicable to the conventional type of electrical connection system wherein the latching and the shorting are released in separate operations, as well as to the electrical connection system according to the present invention wherein the latching and the shorting are released in one continuous operation.

According to the present invention, after the latch element latched in the first position with respect to one of two components is pressed in the both components to bring them into engagement, it can be pressed continuously to a second position in which the shorting of the shorting element in the other component is released by the latch element, as such can effect the connection in one operation as a whole. Also, the latch element is designed to project out from the one component to only a required minimum extent to press the latch element to the second position when the latch element is in the first position, thus enabling the entire connection system to be made compact in size. In addition, the latch element is designed to press in from the first position to the second position, and as such enables the visual check on whether the both components are in the connected state. Further, in the case where the latch element is provided with the restricting portions, when the latch element is pressed from the first position to the second position, it acts to release the shorting of the shorting element and also prevent the both components from being separated from each other, thus accomplishing the full connection of the both components.

What is claimed is:

1. An electrical connection system comprising:

a first component for supporting first electrical connector elements;

a second component for supporting second electrical connector elements engageable with the first electrical connector elements, the second component being engageable with the first component to engage the first electrical connector elements and the second electrical connector elements;

a shorting element, mounted on the first component, electrically shorting the first electrical connector elements; and a latch element moveably supported in the second component in a first position with respect to the second component, the latch element being moveable relative to the first component and the second component when the second component is engaged with the first component to a second position whereat the latching element displaces the shorting element to a non-shorting position and latches to the second component.

2. The electrical connection system according to claim 1, wherein a direction for the second component to be brought into engagement with the first component is in line with a direction for the latch element to be shifted from the first position to the second position.

3. The electrical connection system according to claim 2, wherein the engagement of the second component with the first component and the shift of the latch element from the first position to the second position are effected in succession by pressing the latch element.

4. The electrical connection system according to claim 2 or 3, wherein when the second component is engaged with the first component by pressing the latch element, the latch element latched in the first position is released from the latch and then is allowed to move to the second position.

5. The electrical connection system according to claim 2 or 3, wherein the latch element is latched in the second position to an extent to which it can be returned to the first position.

6. The electrical connection system according to claim 2 or 3, wherein when the latch element is in the first position, a part of the same projects out from the second component, while on the other hand, when it is in the second position, the part of the same is accommodated in a recess in the second component.

7. The electrical connection system according to claim 2 or 3, wherein the latch element has a pair of first legs and a pair of second legs; and wherein a first set of first leg and second leg and a second set of first leg and second leg are arranged in a generally L-like shape, respectively, and also arranged so symmetrically that the second legs can confront each other.

8. The electrical connection system according to claim 1, wherein the latch element is provided with a restricting portion, which takes a restricting position to restrict an action of the second component to disengage from the first component when the latch element is shifted to the second position.

9. The electrical connection system according to claim 8, wherein when the latch element is shifted to the second position, the restricting portion is advanced to a position near the position where the first component and the second component are engaged.

10. The electrical connection system according to claim 9, wherein when the second component is in engagement with the first component, the restricting portion is not in contact with the second component and the first component.

11. An electrical connection system connectable with a first component supporting first electrical connector elements, the electrical connection system comprising:

a second component for supporting second electrical connector elements engageable with the first electrical connector elements, the second component being engageable with the first component to engage the first electrical connector elements and the second electrical connector elements;

a shorting element, mounted on the first component, electrically shorting the first electrical connector elements;

a latch element movably supported in the second component in a first position with respect to the second component, the latch element being movable relative to the first component and the second component when the second component is engaged with the first component to a second position whereat the latching element displaces the shorting element to a non-shorting position and latches to the second component; and a restricting portion provided in the latch element for restricting action of the second component from disengaging from the first component when the latch element is shifted to the second position.

12. The electrical connection system according to claim 11, wherein when the second component is engaged with the first component by pressing the latch element, the latch element latched in the first position is released from the latch and then is allowed to move to the second position.

13. An electrical connection system comprising:

a first component for supporting first electrical connector elements;

a second component for supporting second electrical connector elements engageable with the first electrical connector elements, the second component being engageable with the first component to engage the first electrical connector elements and the second electrical connector elements;

a shorting element, mounted on the first component, electrically shorting the first electrical connector elements;

a latch element movably supported in the second component in a first position with respect to the second component, the latch element being movable relative to the first component and the second component when the second component is engaged with the first component to a second position whereat the latch element displaces the shorting element to a non-shorting position and latches to the second component; and a restricting portion provided in the latch element for restricting action of the second component from disengaging from the first component when the latch element is shifted to the second position.

14. The electrical connection system according to claim 13, wherein when the second component is engaged with the first component by pressing the latch element, the latch element latched in the first position is released from the latch and then is allowed to move to the second position.

* * * * *